US010486008B2

(12) United States Patent
Prihar

(10) Patent No.: US 10,486,008 B2
(45) Date of Patent: Nov. 26, 2019

(54) LOOPED SUSPENSION EXERCISE SYSTEM

(71) Applicant: Liron Prihar, Fort Lauderdale, FL (US)

(72) Inventor: Liron Prihar, Fort Lauderdale, FL (US)

( * ) Notice: Subject to any disclaimer, the term of this patent is extended or adjusted under 35 U.S.C. 154(b) by 0 days.

(21) Appl. No.: 15/390,613

(22) Filed: Dec. 26, 2016

(65) Prior Publication Data

US 2018/0178050 A1 Jun. 28, 2018

(51) Int. Cl.
*A63B 21/00* (2006.01)
*A63B 21/16* (2006.01)
(Continued)

(52) U.S. Cl.
CPC .... *A63B 21/0552* (2013.01); *A63B 21/00065* (2013.01); *A63B 21/0557* (2013.01); *A63B 21/169* (2015.10); *A63B 21/4017* (2015.10); *A63B 21/4035* (2015.10); *A63B 21/4039* (2015.10); *A63B 21/4043* (2015.10); *A63B 23/12* (2013.01); *A63B 71/0054* (2013.01); *A63B 2209/00* (2013.01)

(58) Field of Classification Search
CPC ..... A63B 5/16; A63B 5/166; A63B 2005/163; A63B 7/00; A63B 7/02; A63B 7/04; A63B 7/045; A63B 7/08; A63B 7/085; A63B 21/02; A63B 21/04–21/0557; A63B 21/169; A63B 21/4009; A63B 21/4017; A63B 21/4039; A63B 21/4043; A63B 23/12; A63B 71/0054; A63B 2208/0285; A63B 2208/029
See application file for complete search history.

(56) References Cited

U.S. PATENT DOCUMENTS 4,047,714 A * 9/1977 Powell ..... A63B 21/154 482/131
5,209,712 A * 5/1993 Ferri ..... A61H 1/02 482/131
(Continued)

FOREIGN PATENT DOCUMENTS

DE 102011054094 A1 † 4/2013

OTHER PUBLICATIONS

[WhatsOnDubai]. (Jul. 7, 2014). 4D Pro Reaction Training—full-body workout [Video file]. Retrieved from https://www.youtube.com/watch?v=n4UELkfrA58. (Year: 2014).*

*Primary Examiner* — Joshua Lee
(74) *Attorney, Agent, or Firm* — Andrew Morabito

(57) ABSTRACT

A looped suspension exercise system comprising a mounting plate, wherein the mounting plate has a plurality of openings and a plurality of tabs, a length of non-elastic, wherein the length of non-elastic fabric is attached to the mounting plate the length of non-elastic fabric by trying the length of fabric around the plurality of tabs, a split length of fabric having a first end, a second end, and a third end and the first end, the second end, and the third end have an opening, wherein the first end of the split length of fabric is attached to the second end of the length of non-elastic fabric, a plurality of elastic bands are attached to the second end and the third end of the split length of fabric, and a padded sling, wherein the padded sling is attached to the elastic bands.

15 Claims, 4 Drawing Sheets

(51) Int. Cl.

| | |
|---|---|
| ***A63B 23/12*** | (2006.01) |
| ***A63B 71/00*** | (2006.01) |
| ***A63B 21/055*** | (2006.01) |

(56) References Cited

U.S. PATENT DOCUMENTS 7,255,666 B2 * 8/2007 Cardenas ..... A61H 1/0229 482/143
8,007,413 B1 * 8/2011 Wu ..... A63B 21/068 482/131
8,043,197 B2 * 10/2011 Hetrick ..... A63B 21/0023 482/91
8,152,703 B1 * 4/2012 Hinds ..... A63B 21/00065 482/122
8,197,392 B2 6/2012 Silverman et al.
8,221,293 B2 7/2012 Hoffman et al.
8,979,716 B1 * 3/2015 Rawlins ..... A63B 21/0442 482/129
9,427,622 B2 * 8/2016 Thrasher-Rudd ..... A63B 7/00
9,573,016 B2 * 2/2017 Haddad ..... A63B 21/4043
9,849,327 B2 * 12/2017 Nikkaran ..... A63B 21/068
9,854,898 B2 * 1/2018 Whitley ..... A61G 7/1015
2001/0034291 A1 * 10/2001 Horton ..... A63B 21/0552 482/124
2003/0078142 A1 * 4/2003 Jacobsen ..... A63B 21/0552 482/126
2006/0199711 A1 * 9/2006 Miers ..... A63B 21/0552 482/124
2009/0075790 A1 * 3/2009 Hetrick ..... A63B 21/0023 482/92
2013/0143724 A1 * 6/2013 DeMeo ..... A63B 21/00185 482/131
2013/0190148 A1 * 7/2013 Allison ..... A63B 21/0442 482/129
2014/0005015 A1 * 1/2014 Hester ..... A63B 21/154 482/131
2014/0073496 A1 * 3/2014 Bannerman ..... A63B 21/0442 482/139
2014/0155233 A1 * 6/2014 Latronica ..... D04G 5/00 482/124
2016/0287927 A1 * 10/2016 Hunter ..... A63B 21/4035
2017/0225024 A1 * 8/2017 Thrasher-Rudd ..... A63B 21/0552
2018/0071574 A1 * 3/2018 Reder ..... A63B 23/0205

* cited by examiner
† cited by third party

LOOPED SUSPENSION EXERCISE SYSTEM

BACKGROUND OF THE INVENTION

The present invention relates exercise equipment, and more particularly to an elastic suspended strap for performing various strength, conditioning, or stretching exercises.

Conventional exercise straps extend downwards, towards the ground. The three major designs are single strap, dual strap, and looped strap designs.

Single strap suspension system extends downwards from the mounting point and then splits into two straps. A handle is attached to the ends of each of the two respective straps. A person places his or her hands in the handles and can perform various exercises. One disadvantage of single suspension systems is that because the distance between the split and the ends of the two straps is relatively short, the two straps may rub against the neck, ears, and head of the person during exercising.

Dual strap suspension systems, instead of a single strap being attached, two straps are attached to the mounting points and each strap extends downwards. A handle is attached to the ends of each strap. One disadvantage of dual strap suspension systems is that because the straps are not attached at the same point, the straps act independently of one another and are more difficult to control.

Loop strap suspension systems extend from one or more mounting points and form a continuous loop from to wear around the user's torso or hips. disadvantages of the loop strap suspension system are the multiple mounting points, lack of adjustment of the resistance, and the inability to adjust the system from a looped system to a single strap or dual strap suspension system. The multiple mounting points creates a more difficult installation process, and without the ability to adjust the resistance the current loop designs are limited in function It is therefore an object of this invention to provide a looped exercise strap system that allow the person to quickly and easily mount and adjust the resistance and setup of the exercise system.

SUMMARY

Aspects of an embodiment of the present invention disclose a looped suspension exercise system comprising a mounting plate, wherein the mounting plate has a plurality of openings and a plurality of tabs, a length of non-elastic fabric having a first end and a second end, wherein the second end has an opening, wherein the length of non-elastic fabric is attached to the mounting plate by the first end of the length of non-elastic fabric by trying the length of fabric around the plurality of tabs, a split length of fabric having a first end, a second end, and a third end and the first end, the second end, and the third end have an opening, wherein the first end of the split length of fabric is attached to the second end of the length of non-elastic fabric, a plurality of elastic bands having a first end and a second end are attached to the second end and the third end of the split length of fabric, and a padded sling with a first end and a second end, wherein the first end of the padded sling is attached to a first portion of the elastic bands at the second the second ends of the first portion of the elastic bands, and the second end of the padded sling is attached to a second portion of the elastic bands second ends.

The preferred embodiments of the looped suspension exercise system, wherein the plurality of elastic bands are equally divided and connected to the second end and third end of the split length of fabric. The plurality of elastic bands are made from a bungee material. Each of the plurality of elastic bands are comprised of a plurality of elastic strings. A second padded sling, wherein the padded sling is connected to a predetermined quantity of the plurality of elastic bands and the second padded sling is connected to the remainder of the plurality of elastic bands. A releasable locking mechanism to attach at least one of the mounting plate, the length of non-elastic fabric, the split length of fabric, the plurality of elastic bands, or the padded sling. The padded sling has a foam material positioned in a portion of the sling wherein the padded sling would come in contact with a wearer. The plurality of elastic bands have different strengths. The padded sling has a loop attached to the first end and the second end.

DETAILED DESCRIPTION OF THE INVENTION

Figure 1:
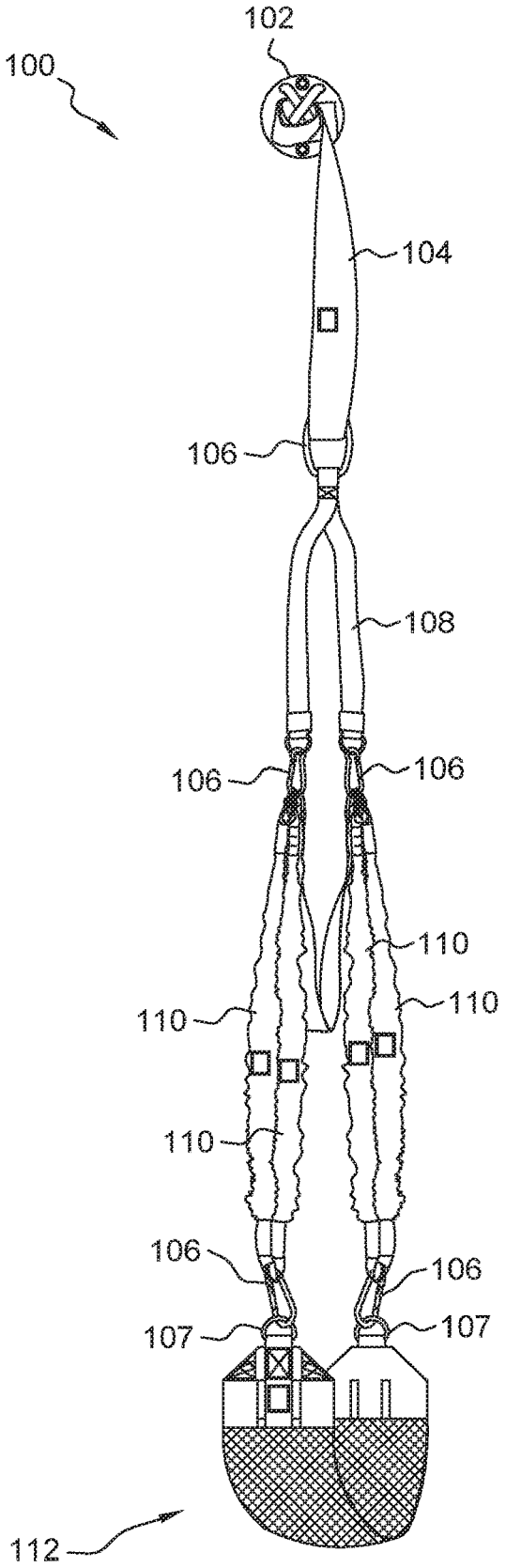
FIG. 1 depicts a view of a looped suspension exercise system, in accordance with one embodiment of the present invention.

The present invention provides a looped suspension exercise system that provides adjustable resistance, simple mounting, and the ability to transform the system quickly and easily depending on the intended workout.

Suspension band exercise has been proven to provide long term benefits such as increased range of movement, improved core stability, improved core strength, decreased risk of injury, increased bone density, increased number and size of mitochondria, increased metabolic rate, decreased blood pressure, decreased blood cholesterol markers, improved posture increased lung capacity/increase in vo2 max, hypertrophy of cardiac tissue, increased blood volume and red blood cell count, increased cardiac output and stroke volume, increased number of capillaries (capillarization), reduction in body fat, and the like.

The present invention allows an individual to train at a 45° angle which takes pressure off of the joints and allows them to complete exercises in which they were not able to do in a standing position with comfort and ease.

One of the many benefits of the present invention is that it offers a major advantage over normal suspension bands due to the benefit of elastic. It uses variable changes in axes to train the body and reduces the bridge on trunk core muscle activity, thereby improving joint mobility, stretching, muscle endurance, relaxation, and trunk stabilization. An additional benefit is that it reduces your body weight as well as the risk of injury.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. It is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present invention is not entitled to antedate such publication by virtue of prior invention. Further, the dates of publication provided may be different from the actual publication dates which may need to be independently confirmed.

It must be noted that as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

FIG. 1 depicts a view of the looped suspension exercise system 100, in accordance with one embodiment of the present invention. The looped suspension exercise system (hereinafter "suspension system") 100 is comprised of a mounting plate 102, a mounting strap 104, an adjustment member 108, elastic members 110, and a sling assembly 112, which are connected by a clasping mechanism 106 and rings 107 in strategic locations. In the shown embodiment, there are four (4) elastic members 110 connected to the adjustment member 108 and sling assembly 112. In additional embodiments, the number of elastic members 110 can be increased or decreased to adjust the resistance of the suspension system 100.

The mounting plate 102 is designed to anchor the suspension system 100 to a solid surface. The mounting plate 102 can be made from metal or another material that can withstand the forces applied to it while a user is using the suspension system 100. The mounting plate 102 is affixed to the wall or surface via a plurality of openings 115 located on the mounting plate 102. The openings 115 are located so that they do not interfere with mounting bars 101. The mounting bars 101 are positioned in a cross pattern to allow the mounting strap 104 to be affixed to the mounting plate 102. In the shown embodiment, the mounting strap 104 is attached to the mounting bars 101 by tying the mounting strap 104 around the mounting bars 101. In additional embodiments, a clasping mechanism 106 can be used to attach the mounting strap 104 to the mounting bars 101. In additional embodiments, the number of openings 115 and mounting bars 101 may be increased or decreased to accommodate different user's.

The mounting strap 104 is a length of cord or material that has an opening 105 at one end of the mounting strap that is opposite the end of the mounting strap 104 that is attached to the mounting plate. 102. The mounting strap 104 may be made from a non-stretchable material such as cotton, nylon, polyester, polyethylene fibers, aramid fibers, leather, or the like. The mounting strap 104 is connected to the adjustment member 108 via connection mechanism 106 which extends through the opening 105 and another opening in the adjustment member 108. In additional embodiments, the adjustment member 108 may have a ring 107 that the connection mechanism 106 attaches with.

The connection mechanism 106 may be a snap ring, carabiner, or other mechanism that is releasable and has the structural strength to hold up the weight of the suspension system 100 and a user. The connection mechanism 106 may have a locking mechanism incorporated into the design to prevent the suspension system 100 elements from disengaging from one another. This provides additional safety features of the device.

Rings 107 are that connection mechanism 107 can attached with to allow two or more elements of the suspension system 100 to connect to one another and remain secured while the suspension system is in operation. The rings 107 may be a solid ring or could alternatively be a round carabiner or split ring that permits the suspension system 100 elements to be removably joined. Alternatively, the ring 107 could be replaced with a rigid "D" shaped design. Such a configuration would have the straight portion of the "D" shaped structure hinged to the end of the element. A still further alternative would replace the "D" shape with a "C" shape rigid member that has its ends hooked into holes at the upper and lower end corners.

The adjustment member 108 is a combination a several lengths of material that provides for several mounting positions and setups for the suspension system 100. The shown embodiment of the adjustment member 108 is a first length of material that is affixed to a second and a third length of material to form a "Y" design. This design allows the suspension system 100 to widen out for the sling assembly 112 to fit a user. The length of the first, second, and third material is based on the desired mounting height, size of the user, and desired exercised to be performed by the suspension system 100. At the ends of the second and third length of material is a ring 107. The "Y" design allows for a perpendicular and substantially equal distribution of force to the sling assembly 112. In the shown embodiment, the adjustment member 108 is attached to the elastic members 110 via the rings 107 and the connection mechanism 106. In additional embodiments, the sling assembly 112 or other handles or equipment can be directly attached to the adjustment member 108. The adjustment member 108 is may be made of a flexible, non-stretchable fabric such as cotton, nylon webbing, polyester, polyethylene fibers, aramid fibers, leather, or the like.

Figure 2:
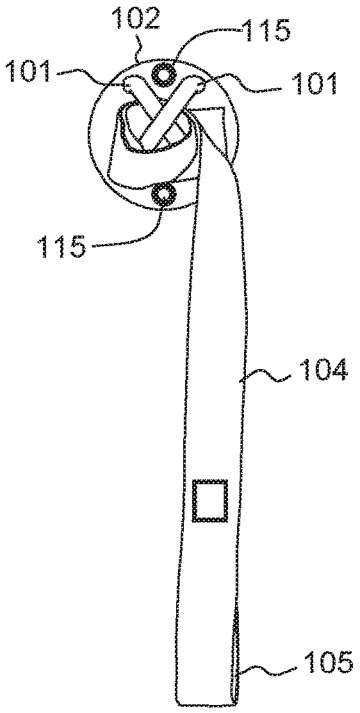
FIG. 2 depicts a view of a mounting portion of the looped suspension exercise system, in accordance with one embodiment of the present invention.

The elastic members 110 is attached to the to adjustment member 108 via a plurality of rings 107 and connection mechanisms 106. The elastic members 110 extend a predetermined length and with a predetermined elasticity, to allow for the proper placement and resistance for the user. The elastic portion of the elastic members 110 may be contained within an equally as elastic cloth material, as shown in FIG. 1. Each elastic member 110 has a ring 107 affixed to each end of the elastic member 110 for easy attachment and disengagement when adjusting the exercise, resistance, or removing the suspension system 100. In some embodiments, the elastic member 100 may optionally be covered by a soft fabric or neoprene sleeve in order to minimize interference with the user's arm movements and friction discomfort during exercise The sling assembly 112 is comprised of a pad 113 that is both flexible to shape to the contour of the user's body and affixed to a section of material 109 that receives a ring 107 to attached to the elastic members 100. The band. The pad 113 is a generally rectangular and cushioned or covered with soft material for comfort during use. The pad 113 may be a flat rectangular length of material similar to the material used in the other elements of the suspension system 100. In one embodiment, the pad 113 may be curved and shaped for comfort anatomically complementary to a user's pelvic/abdominal area. The pad 113 structure should have a rigid base layer which is form fitting to the user's body at the height of the upper pelvis/abdominal area. This will permit a user to spread the forces evenly among areas in contact without compressing the pelvic joints or other portions of the body. The width of the pad 113 is wide enough, so that it preferably does not extend outward beyond a user's pelvis so that the user's arms can swing freely during exercise without hitting the pad 113. The height of the pad 113 should sufficient for comfort but not so high as to interfere with leg motion or breathing. In some embodiments, the pad 113 has a friction or nonslip coating to prevent the movement of the pad while in use. Optional pads may be provided to the pad 113 for additional cushioning FIG. 2 depicts a view of a mounting portion of the suspension system 100, in accordance with one embodiment of the present invention. The mounting strap 104 is attached to the mounting plate 102 by wrapping the mounting strap 104 around the mounting bars 101 so that the suspension system 100 is secured to the surface. The length of the mount strap 104 is long enough to provide adequate length to attached to the mounting plate 102 and still hang a predetermined distance from the ground.

Figure 3:
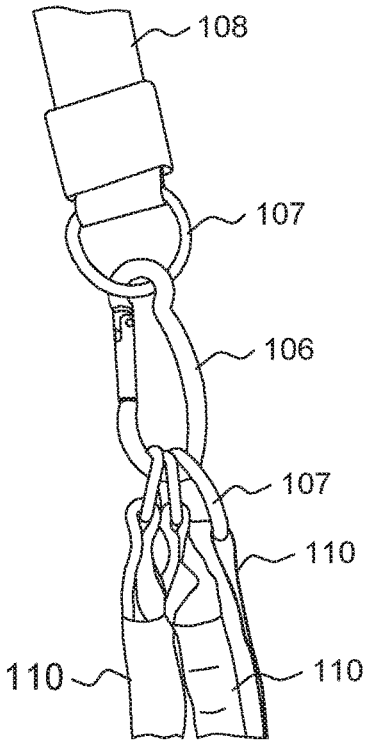
FIG. 3 depicts a view of a mounting mechanism for a pad of the looped suspension exercise system, in accordance with one embodiment of the present invention.

FIG. 3 depicts a view of connection point between the adjustment member 108 and the elastic members 110 of the suspension system 100, in accordance with one embodiment of the present invention. It is shown that a ring 107 is affixed to the adjustment member 108 and a ring is affixed to the elastic member 110 and a connection mechanism is used to join these two elements together. The ring 107 can be affixed to the elements by sewing them into each element, or other means to provide a secure means of affixing the two elements together.

Figure 4:
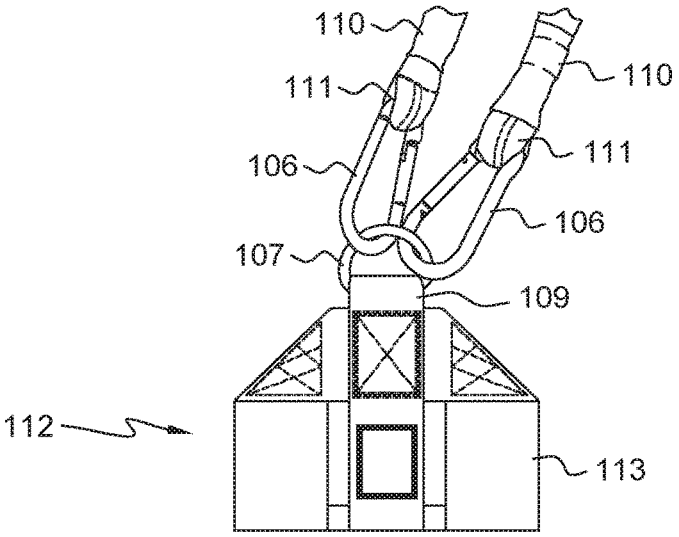
FIG. 4 depicts a view of a mounting mechanism for the mounting portion of the looped suspension exercise system, in accordance with one embodiment of the present invention.

FIG. 4 depicts a view of the connection of the elastic members 110 and the sling assembly 112, in accordance with one embodiment of the present invention. It is shown that the elastic members 110 have a loop wherein a connection mechanism 106 passes through, and the sling assembly 112 has a ring 107 affixed to the sling assembly 11 by a length of material 109 that is affixed to the padding 113. The length of material 109 may be affixed to the padding by stitching or sewing the two elements together. In the elastic member 110 the loop may be formed by stitching or sewing and may involve additional pieces of material to create the loop.

Figure 5:
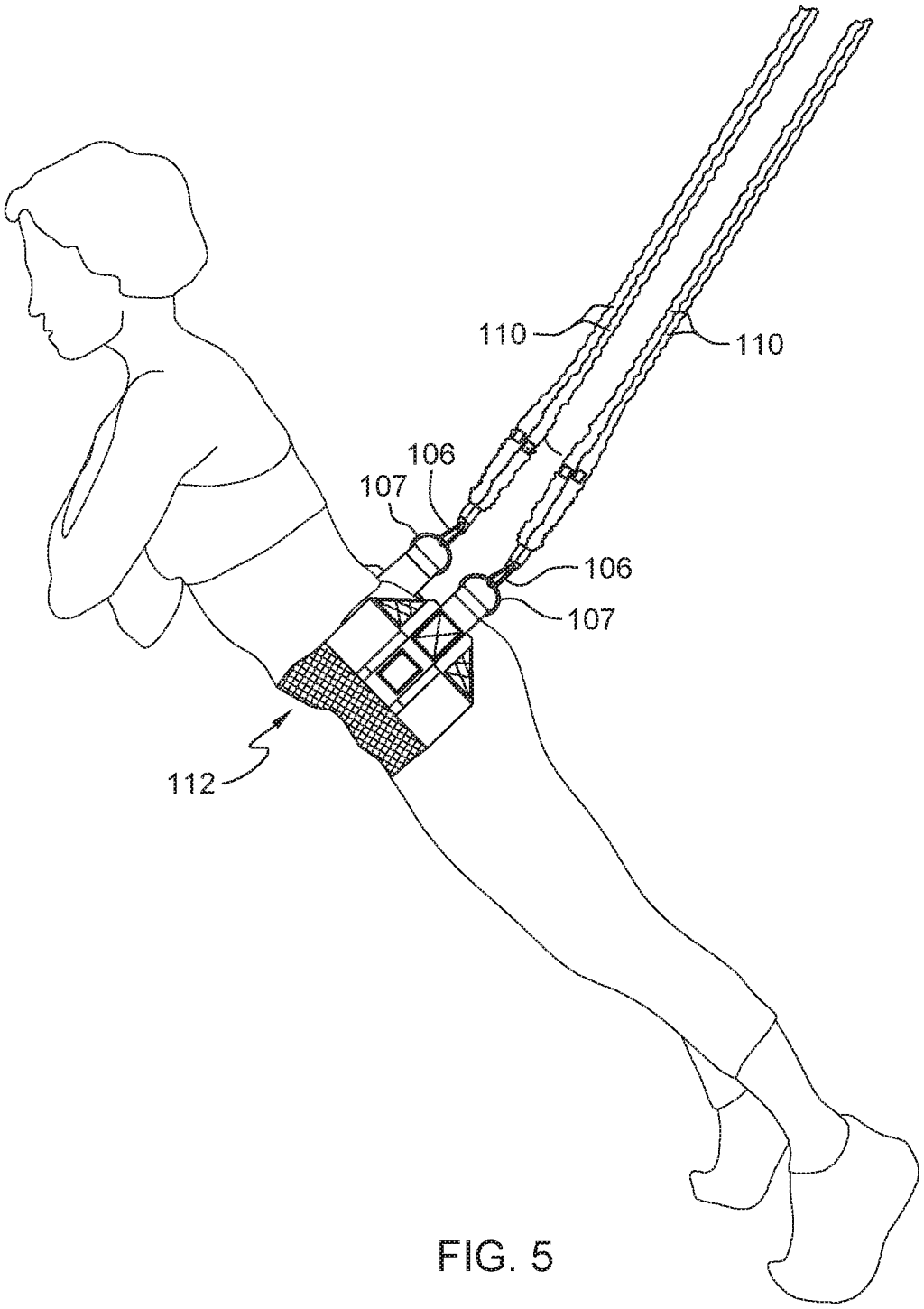
FIG. 5 depicts a view of a person using the looped suspension exercise system, in accordance with one embodiment of the present invention.

FIG. 5 depicts a view of a person using the suspension system 100, in accordance with one embodiment of the present invention. In the shown embodiment, a person using the suspension system 100 in a first method, wherein the user is wearing the sling assembly 112 around the user's pelvic area, and is using the elasticity of the elastic members 110 to perform various workouts.

Figure 6:
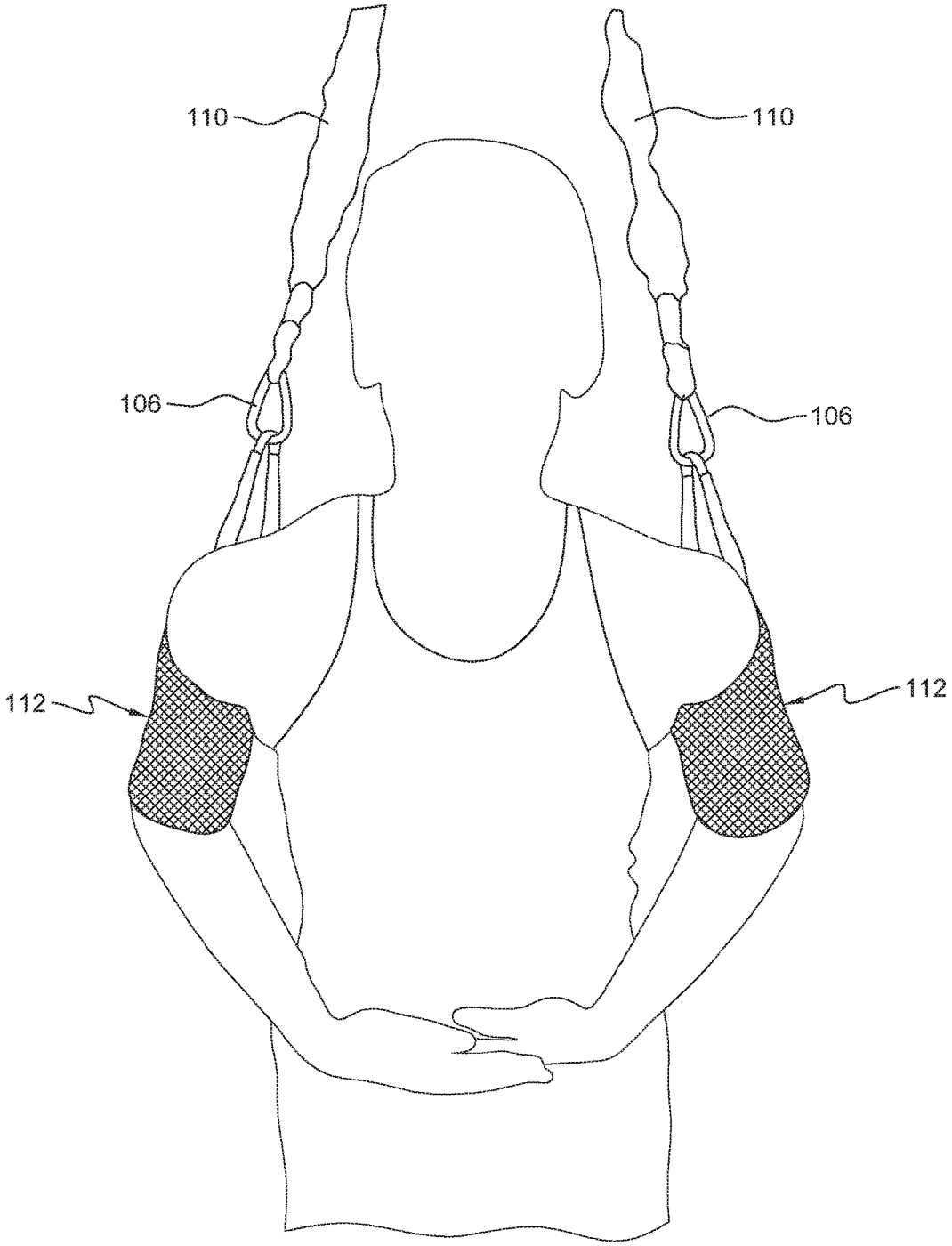
FIG. 6 depicts a view of a person using the looped suspension exercise system in an alternative method, in accordance with one embodiment of the present invention.

FIG. 6 depicts a view of a person using the suspension system 100 in an alternative method, in accordance with one embodiment of the present invention. In the shown embodiment, a person is using the suspension system 100 in an alternative method where by each elastic member 110 is attached to a separate sling assembly 112 to allow for various other exercises to be performed. This shows that each elastic member 110 can have a handle or sling assembly 112 attached to it allow for a greater diversity in exercises performed with this one piece of equipment.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

What is claimed is:

1. A looped suspension exercise system comprising:

a mounting plate, wherein the mounting plate has a plurality of openings and a plurality of tabs;

a first length of non-elastic fabric having a first end and a second end, wherein the second end has an opening, wherein the first length of non-elastic fabric is attached to the plurality of tabs of the mounting plate;

a second length of fabric having a first end, a second end, and a third end, wherein the first end, the second end, and the third end each has an opening, wherein the first end of the second length of fabric is attached to the second end of the first length of non-elastic fabric;

a plurality of elastic bands each having a first end and a second end, wherein the second end and the third end of the second length of fabric are configured for direct attachment to the first end of the plurality of elastic bands; and a padded sling with a first end and a second end, wherein the first end of the padded sling is attached to second ends of a first group of the plurality of elastic bands, and the second end of the padded sling is attached to second ends of a second group of the plurality of elastic bands.

2. The looped suspension exercise system of claim 1, wherein the plurality of elastic bands are equally divided and connected to the second end and third end of the split length of fabric.

3. The looped suspension exercise system of claim 1, wherein the plurality of elastic bands are made from a bungee material.

4. The looped suspension exercise system of claim 1, wherein each of the plurality of elastic bands is comprised of a plurality of elastic strings.

5. The looped suspension exercise system of claim 1, further comprising a second padded sling, wherein the padded sling is connected to a predetermined quantity of the plurality of elastic bands and the second padded sling is connected to the remainder of the plurality of elastic bands.

6. The looped suspension exercise system of claim 1, wherein the padded sling has a foam material positioned in a portion of the sling wherein the padded sling would come in contact with a wearer.

7. The looped suspension exercise system of claim 1, wherein the plurality of elastic bands have different strengths.

8. A looped suspension exercise system comprising:

a mounting plate, wherein the mounting plate has a plurality of openings and a plurality of tabs;

a first length of non-elastic fabric having a first end and a second end, wherein the second end has an opening, wherein the first length of non-elastic fabric is attached to the plurality of tabs of the mounting plate;

a split length of fabric having a first end, a second end, and a third end, wherein the first end, the second end, and the third end each has an opening, wherein the first end of the split length of fabric is attached to the second end of the first length of non-elastic fabric;

a plurality of elastic bands each having a first end and a second end, wherein the second end and the third end of the split length of fabric are configured for direct attachment to the first end of the plurality of elastic bands; and a padded sling with a first end and a second end, wherein the first end of the padded sling is attached to second ends of a first group of the plurality of elastic bands, and the second end of the padded sling is attached to second ends of a second group of the plurality of elastic bands.

9. The looped suspension exercise system of claim 8, wherein the plurality of elastic bands are equally divided and connected to the second end and third end of the split length of fabric.

10. The looped suspension exercise system of claim 8, wherein the plurality of elastic bands are made from a bungee material.

11. The looped suspension exercise system of claim 8, wherein each of the plurality of elastic bands is comprised of a plurality of elastic strings.

12. The looped suspension exercise system of claim 8, further comprising a second padded sling, wherein the padded sling is connected to a predetermined quantity of the plurality of elastic bands and the second padded sling is connected to the remainder of the plurality of elastic bands.

13. The looped suspension exercise system of claim 8, wherein the padded sling has a foam material positioned in a portion of the sling wherein the padded sling would come in contact with a wearer.

14. The looped suspension exercise system of claim 8, wherein the plurality of elastic bands have different strengths.

15. The looped suspension exercise system of claim 8, wherein the padded sling has a loop attached to the first end and the second end.

* * * * *